US005637250A

United States Patent [19]

Pegoraro et al.

[11] Patent Number: 5,637,250

[45] Date of Patent: Jun. 10, 1997

[54] DEVICE FOR AUTOMATICALLY OPERATING SLIDE GATES FOR LIQUID METAL CONTAINERS

[75] Inventors: Cesare Pegoraro, Udine; Marcello Martini, Venezia Mestre, both of Italy

[73] Assignee: Nuova Sirma S.p.A., Venezia Malcontenta, Italy

[21] Appl. No.: 454,187

[22] PCT Filed: Oct. 12, 1993

[86] PCT No.: PCT/EP93/02795

§ 371 Date: May 23, 1996

§ 102(e) Date: May 23, 1996

[87] PCT Pub. No.: WO94/13417

PCT Pub. Date: Jun. 23, 1994

[30] Foreign Application Priority Data

Dec. 15, 1992 [IT] Italy ..... VE92A0053

[51] Int. Cl.[6] ..... B22D 41/08

[52] U.S. Cl. ..... 222/600; 222/597

[58] Field of Search ..... 222/600, 597, 222/591; 266/236

[56] References Cited

U.S. PATENT DOCUMENTS

| | | | |
|---|---|---|---|
| 4,168,790 | 9/1979 | Lothmann et al. | 222/600 |
| 5,421,563 | 6/1995 | Holtermann et al. | 222/600 |

*Primary Examiner*—Scott Kastler
*Attorney, Agent, or Firm*—Hoffman, Wasson & Gitler

[57] ABSTRACT

A device for automatically operating slide gates for liquid metal containers, involving a fixed plate assembly rigid with a container base and a movable plate assembly hinged to the fixed plate assembly along a support element provided near a lateral edge thereof, and engageable with the fixed assembly when the slide gate structure is close. The device has means which first cause the pure axial translation of the support element so as to cause the movable plate assembly to slide tangentially with respect to the fixed plate assembly thus disaligning the pouring holes of the two plates, and then cause the axial rotation of the support to cause the movable plate assembly to rotate relative to the fixed plate assembly thus carrying out the opening of the slide gate structure.

9 Claims, 2 Drawing Sheets

DEVICE FOR AUTOMATICALLY OPERATING SLIDE GATES FOR LIQUID METAL CONTAINERS

FIELD OF THE INVENTION

This invention relates to a device for automatically operating slide gates for liquid metal containers.

BACKGROUND OF THE INVENTION

Known slide gates are provide at the pouring hole of liquid metal containers, in particular tundishes and ladles. They comprise a base plate rigid with the base plate and a movable plate kept adhering to the fixed plate in a manner movable tangentially thereto. Both the plates comprise a hole which when the plates face each other are aligned to allow the pouring jet to pass, and which when the position of the movable plate is varied relative to the fixed plate intercept this jet.

Slide gates in the form of three superposed plates are also known, of which the two outer plates are fixed and are each provided with a hole coaxial to that of the other plate, whereas the intermediate plate, also provided with a hole, is movable longitudinally between the two fixed plates to align its hole with the holes in these, and achieve a continuous passage for the molten metal towards the underlying casting trough.

These slide gates are generally provided with coupling systems for the two/three plates, consisting of a support structure housing springs which act in the sense of pressing the lower plate against the upper plate to ensure sealed contact, and a plurality of locking members and levers which retain the plates together and enable the slide gate to be opened and closed.

As the opening/closure of the gate structure and the replacement of the worn refractories are done manually, these known slide gates have certain drawbacks, and in particular:

they require prolonged down-time for opening/closing the gate structure and replacing worn refractories, they require considerable physical force from the operator operating the opening and closure levers, they create an uncomfortable environment for the operator, who is exposed for a long time to the heat generated during the opening of the ladle/tundish when removing worn refractories.

In addition the need to open/close the gate structure manually means that from the plant design aspect the slide gate has to be installed in such a manner as to be able to be opened with the least possible force by the operator. This results in installation difficulty and additional costs for the devices required for its operation.

DISCUSSION OF THE PRIOR ART

DE-A-4006064 discloses a closure for the base outlet opening of a casting ladle having a sliding plate which moves to and from within a housing swinging round a pivot axis.

An object of the invention is to provide a device for its automatic operation, in particular for opening/closing the gate structure, which combines a high level of sealing with extremely easy and fast operation.

A further object is to provide a device which enables worn refractories to be easily and quickly replaced.

These and further objects are achieved according to the inventor through a device for automatically operating slide gates for liquid metal containers in general, said slide gate comprising a fixed plate assembly rigid with a container base and a movable plate assembly hinged to said fixed plate assembly along a support element provided near a lateral edge thereof, and engageable with said fixed assembly when the slide gate structure is close, characterised by comprising means which firstly causes the pure axial translation of said support element so as to cause said movable plate assembly to slide tangential with respect to the fixed plate assembly thus disaligning the pouring holes of the two plates and to secondly cause the axial rotation of said support to cause said movable plate assembly to rotate relative to said fixed plate assembly thus carrying out the opening of the slide gate structure and vice-versa.

A preferred embodiment of the present invention is described in detail hereinafter with reference to the accompanying drawings, in which:

DESCRIPTION OF THE PREFERRED EMBODIMENTS

Figure 1:
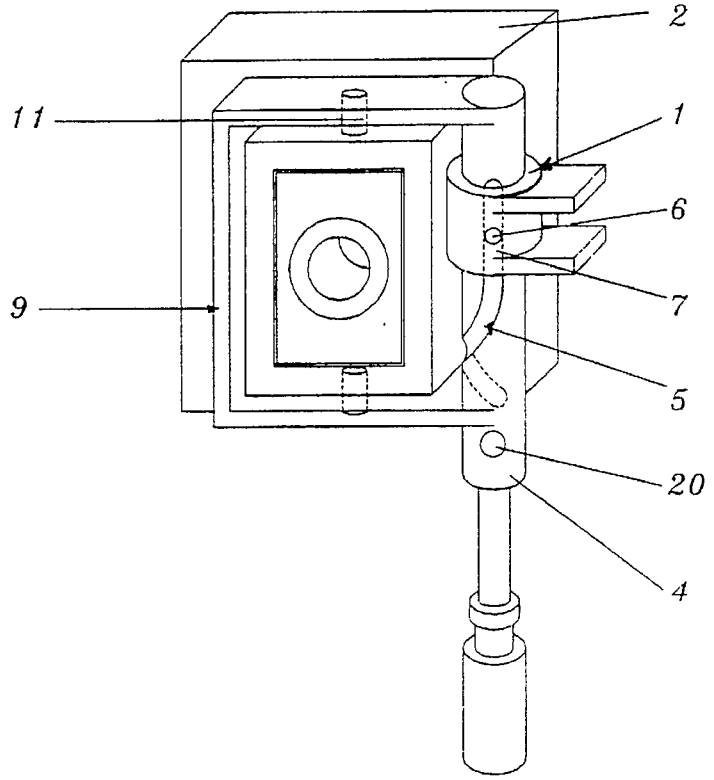
FIG. 1 is a perspective view of the device of the invention from below.
Figure 2:
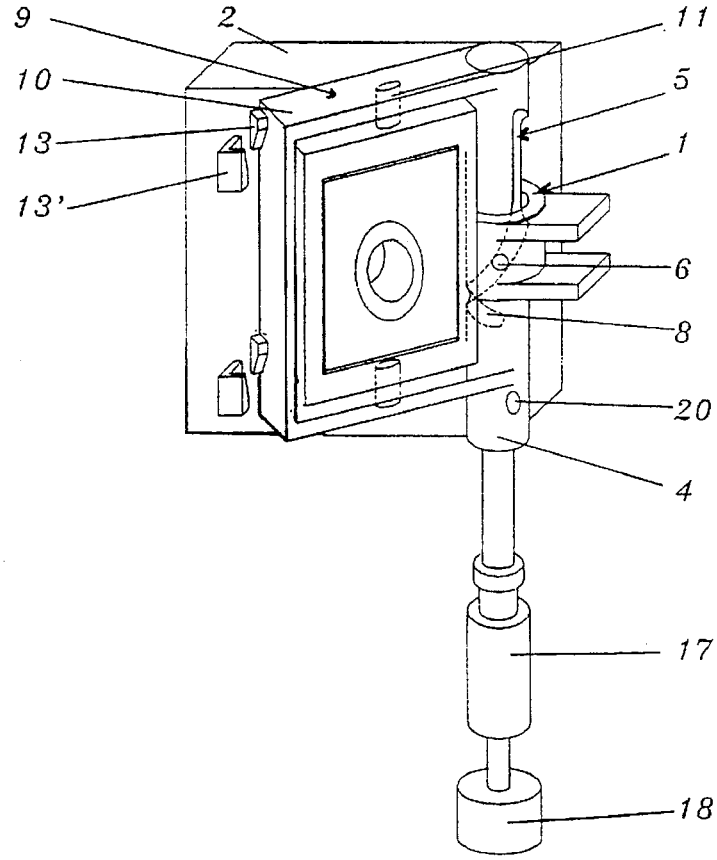
FIG. 2 shows it during the opening of the gate structure.
Figure 3:
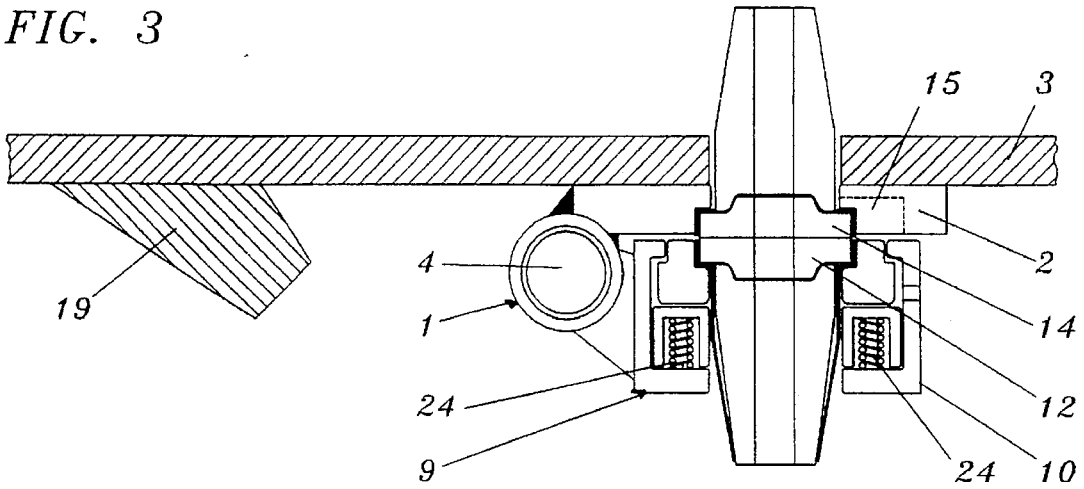
FIG. 3 is a schematic cross-section through the device of the invention with the gate structure closed.
Figure 4:
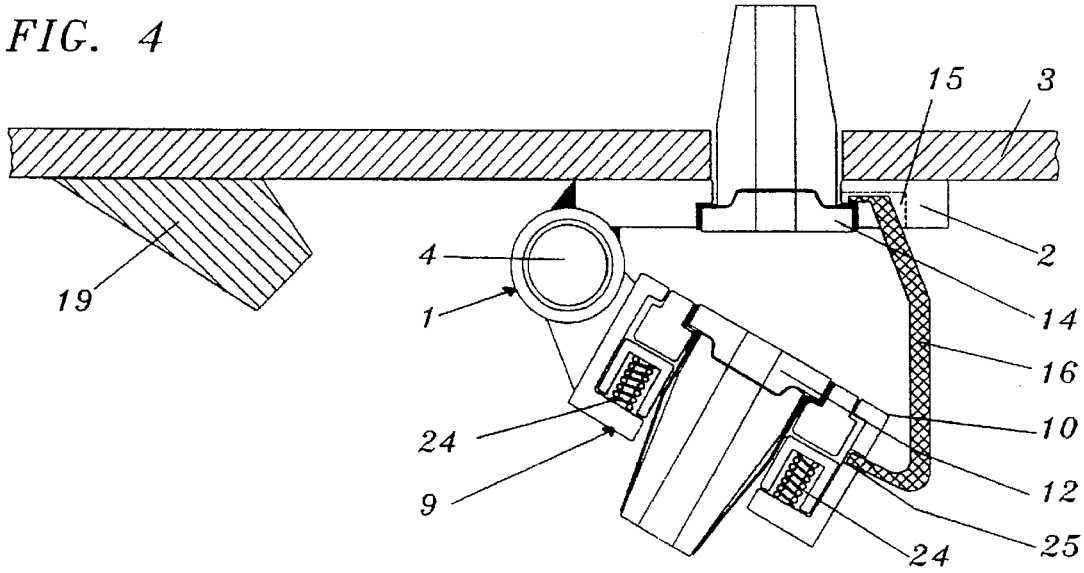
FIG. 4 is the same view as FIG. 3 but in the partially open condition.
Figure 5:
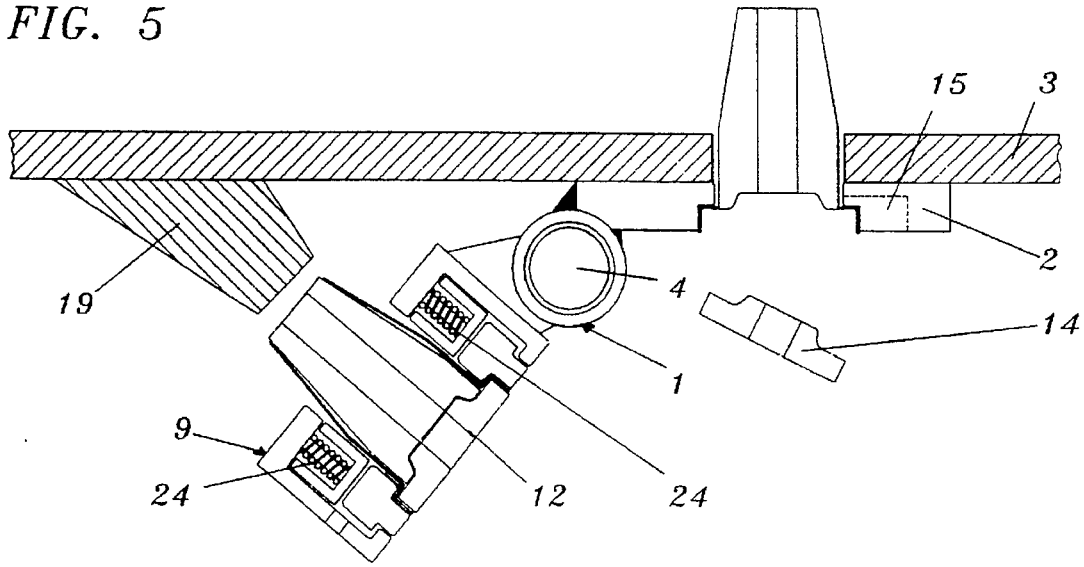
FIG. 5 shows it with the gate structure completely open.

As can be seen from the figures, the device of the invention is mounted on the outer casing of a tundish/ladle at the pouring hole. It comprises substantially a sleeve-type support 1 provided with bushes of antifriction material for a shaft 4 and rigid with the fixed plate assembly 2, which is welded to the outer casing of the tundish/ladle 3.

The lateral surface of the shaft 4 comprises a combination groove 5 in which a pin 6 provided on the inside of the sleeve support 1 is guided.

Specifically, the groove 5 comprises a rectilinear portion 7 parallel to the axis of the shaft 4 and a curved portion 8 facing the movable plate assembly 9 of the slide gate.

Said plate assembly 9 comprises a frame 10 provided with pins 11 for the hinging of the carrier carrying the movable plate 12 of the slide gate. The carrier also houses a plurality of springs 24 arranged to compress the movable fixed plate 12 against the fixed plate 14 when the gate structure is closed.

The frame 10 is also provided with two coupling members 13 of inclined surface type which when the gate structure is closed cooperate with corresponding coupling members 13' of inclined surface type provided on the fixed plate assembly 2 and having a length slightly less than the length of the portion 7. The fixed plate assembly comprises a seat for housing the fixed plate 14 and is also provided with a seat 15 for inserting an implement 16 when opening the gate structure.

At one end of the shaft 4 there is mounted a coupling 17 for connecting a hydraulic cylinder-piston unit 18 acting in the sense of axially moving the shaft.

The invention also comprises the use of an expulsion member 19 welded to the outer casing of the ladle/tundish and facing the movable plate when this is in the position which it assumes following axial movement of the gate.

The device of the invention operates as follows: when the gate structure is closed the movable plate 9 faces and is engaged with the fixed plate assembly by means of the inclined surface coupling members 13, 13'. When in this configuration the pin 6 lies at the closed end of the rectilinear portion 7 of the groove 5.

In this configuration the holes in the fixed plate 14 and movable plate 12 are mutually aligned to enable the pouring jet to leave the ladle/tundish. To open the gate structure the operator firstly disengages a safety pin 20 passing through the shaft 4 to prevent its involuntary sliding, and then connects the hydraulic cylinder-piston unit 18 to the shaft 4 by means of the coupling 17.

Following fluid feed to the hydraulic cylinder-piston unit, its rod emerges to axially move the shaft 4 which, guided by the pin 6 engaged in the rectilinear portion 7 of the groove 5, moves with pure translational movement to drag the movable plate assembly 9 rigid with it, so moving it longitudinally relative to the fixed plate assembly 2. As the shaft 4 moves axially, the inclined surface coupling members 13, 13' disengage to allow discharge of the elastic compression energy of the springs 24 which retain the two plates in mutual contact.

In the meantime the pin 6 has reached the other end of the rectilinear portion of the groove, so that the shaft begins to rotate about its axis by virtue of the guided engagement of the pin 6 in the curved portion 8, with consequent outward rotation of the movable plate assembly rigid with it.

At this stage the implement 16 is inserted automatically or manually into the seat 15 in the fixed plate assembly 2 and into a seat 25 in the movable plate assembly 9 which, continuing to rotate, exerts a dragging action on the implement 16, to release the fixed plate 14 from its seat 15.

When the rotation of the movable plate assembly 9 is complete the plate 12 faces the expulsion member 19 which interferes with it to disengage it from its carrier. The movable plate 12 and fixed plate 14 can now be replaced, after which the hydraulic cylinder-piston unit 18 retracts its rod to consequently cause the shaft connected to it to travel rearwards. As a result, the movable plate assembly 9 firstly rotates until it reaches a position parallel to the fixed plate assembly 2, after which it undergoes purely translational movement resulting in engagement of the inclined surface coupling members 13, 13" with each other until the movable plate assembly is again engaged with the fixed plate assembly.

From the aforegoing it is apparent that the automatic device of the present invention has numerous advantages, and in particular:

it reduces down-time for opening/closing the gate structure because of automation of all operating stages;

it requires no physical force by the operator, either to open/close the gate structure or to remove the refractories, as these operations are effected automatically;

it can be mounted on an already existing two/three plate slide gate, which can be achieved by simply hinging the movable plate carrier to the frame 10 rigid with the shaft 4;

the gate can be easily installed during the assembly of the plant because of the facility for orientating it in the desired position;

it can also be used for controlling the pouring rate. For this purpose, with the gate structure closed and the pin 6 at the closed end of the rectilinear portion 7, the holes in the fixed plate and movable plate are not aligned, hence preventing pouring. The first rectilinear travel part can therefore be used to bring the holes in the two plates into alignment, and the remaining part can be used to open the gate structure.

In another embodiment, not shown on the drawings, the pin 6 is mounted on the shaft 4 and the groove 5 is provided in the sleeve-type support 1.

We claim:

1. A device for automatically operating slide gates for liquid metal containers, said slide gate comprising a fixed plate assembly rigidly affixed to a container base and a movable plate assembly hinged to said fixed plate assembly along a support element provided near a lateral edge thereof, and engageable with said fixed assembly when the slide gate structure is closed, and further comprising means which in a first phase causes said movable plate assembly to slide tangentially with respect to the fixed plate assembly thus disaligning the pouring holes of the two plates and in a second phase cause the axial rotation of said support to cause said movable plate assembly to rotate relative to said fixed plate assembly thus carrying out hinged opening of the fixed and movable plates of the slide gate structure and vice-versa.

2. A device for automatically operating slide gates for liquid metal containers, said slide gate comprising a fixed plate assembly rigidly affixed to a container base and a movable plate assembly hinged to said fixed plate assembly along a support element provided near a lateral edge thereof, and engagable with said fixed assembly when slide gate structure is closed, and further comprising means which first cause said movable plate assembly to slide tangentially with respect to said fixed plate assembly disaligning pouring holes of said fixed plate and said movable plate and secondly causing the axial rotation of said support to cause said movable plate assembly to rotate relative to said fixed plate assembly thus carrying out the opening of said slide gate structure and vice versa, wherein the support element comprises a shaft axially slidable within a sleeve rigid with the container base, said shaft and said sleeve being provided respectively with a pin and a combination groove for guiding said shaft relative to said sleeve during opening or closing of said gate structure.

3. A device as claimed in claim 1, wherein said sleeve (1) is lined internally with antifriction material.

4. A device as claimed in claim 2, wherein said shaft is provided with a coupling for connection to a rod of a hydraulic cylinder-piston unit.

5. A device as claimed in claim 2, wherein said shaft is provided with a transverse safety pin for preventing its involuntary operation.

6. A device as claimed in claim 2, wherein a frame supporting the movable plate is rigid with the shaft.

7. A device as claimed in claim 1, further comprising a coupling element engageable in the plate of the fixed plate assembly and in the movable plate assembly during rotation of the movable plate assembly relative to said fixed plate assembly.

8. A device as claimed in claim 1, wherein a counteracting element is associated with the container base, to interfere with the outer part of the movable plate of the movable plate assembly during the rotation of said plate assembly.

9. A device as claimed in claim 1, wherein said movable plate assembly and the fixed plate assembly are provided with coupling members having inclined surfaces.

* * * * *